US011791572B2

(12) United States Patent
Chen

(10) Patent No.: US 11,791,572 B2
(45) Date of Patent: Oct. 17, 2023

(54) WIRING TERMINAL

(71) Applicant: XIAMEN GHGM INDUSTRIAL TRADE CO., LTD, Xiamen (CN)

(72) Inventor: Bingshui Chen, Xiamen (CN)

( * ) Notice: Subject to any disclaimer, the term of this patent is extended or adjusted under 35 U.S.C. 154(b) by 105 days.

(21) Appl. No.: 17/523,786

(22) Filed: Nov. 10, 2021

(65) Prior Publication Data

US 2022/0393370 A1 Dec. 8, 2022

(30) Foreign Application Priority Data

Jun. 4, 2021 (CN) ..... 202110626758.6

(51) Int. Cl.
*H01R 4/48* (2006.01)

(52) U.S. Cl.
CPC ..... *H01R 4/4836* (2013.01)

(58) Field of Classification Search
CPC ..... H01R 4/48–4845
See application file for complete search history.

(56) References Cited

U.S. PATENT DOCUMENTS 9,478,874 B2 * 10/2016 Stolze ..... H01R 4/4845
9,525,219 B2 * 12/2016 Köllmann ..... H01R 4/4845
10,658,767 B2 * 5/2020 Koellmann ..... H01R 13/115

* cited by examiner

*Primary Examiner* — Ross N Gushi
(74) *Attorney, Agent, or Firm* — THE LAW OFFICE OF AUSTIN BONDERER, PC; Austin Bonderer

(57) ABSTRACT

This utility model provides a wiring terminal, used for receiving and connecting to a conducting wire, the wiring terminal including: a housing, provided with a mounting channel and an insertion hole communicating with the mounting channel for the conducting wire to be inserted; a conductive piece and a clamping piece, both of which are arranged in the mounting channel, where the conductive piece and the clamping piece cooperate to form a natural state in which the conducting wire placed in the mounting channel is clamped between the clamping piece and the conductive piece through elastic abutment and a pressed state in which the conductive piece and the clamping piece are controlled by an external force to deform in a direction distal from the clamped conducting wire.

7 Claims, 6 Drawing Sheets

WIRING TERMINAL

FIELD OF TECHNOLOGY

This utility model relates to the technical field of electric wiring apparatuses, specifically, a wiring terminal.

BACKGROUND

A wiring terminal is a wiring apparatus that can disassemble and assemble an external conducting wire. At present, the wiring terminal generally presses an inserted conducting wire by using an internal clamping and connecting piece to implement an electrical connection. During use, a plurality of conducting wires are separately inserted into a housing, and a mutual electrical connection between the inserted conducting wires is implemented when the clamping and connecting piece is used for pressing. When the conducting wire needs to be drawn away, the conducting wire may be directly drawn away to make the clamping and connecting piece elastically deform to implement detachment of the conducting wire. The current wiring terminal is not conducive to insertion or drawing away of the conducting wire. During use, the conducting wire needs to be inserted or drawn away frequently, which results in a relatively unstable clamping and connecting piece, thereby affecting clamping, disassembly, and assembly of the conducting wire and making the wiring terminal fail to work usually and efficiently. Given this, a researcher puts forward this application after researching the prior art.

SUMMARY

This utility model discloses a wiring terminal, which aims to improve the inconvenience in disassembling and assembling conducting wires of the existing wiring terminal.

This utility model adopts the following solution: This application provides a wiring terminal used for receiving and connecting to a conducting wire. The wiring terminal including:

- a housing, provided with a mounting channel and an insertion hole communicating with the mounting channel for the conducting wire to be inserted;
- a conductive piece and a clamping piece, both of which are arranged in the mounting channel, where the conductive piece and the clamping piece cooperate to form a natural state in which the conducting wire placed in the mounting channel is clamped between the clamping piece and the conductive piece through elastic abutment and a pressed state in which the conductive piece and the clamping piece are controlled by an external force to deform in a direction distal from a clamped conducting wire, and the conductive piece has an inclined surface parallel to one surface of the clamping piece, and the inclined surface is in close contact with a corresponding surface parallel to the inclined surface in the clamping piece; and
- a wiring switch, where the wiring switch is capable of correspondingly triggering relative positions of the conductive piece and the clamping piece so that the conductive piece and the clamping piece switch between the natural state and the pressed state.

Preferably, the conductive piece is of a C-shaped frame structure with a conductive piece upper part and a conductive piece lower part, the clamping piece is in a straight-line shaped structure, a lower part end of the conductive piece is provided with a first inclined surface, a clamping piece lower part is provided with a second inclined surface, and the first inclined surface and the second inclined surface are parallel to each other and are closely attached through a connecting structure.

Preferably, the connecting structure includes a first connecting structure on a conductive piece side portion and a second connecting structure on a clamping piece side portion, both the first connecting structure and the second connecting structure are hook-shaped structures, and the first inclined surface and the second inclined surface are mutually fitted through the mutually hooking and riveting of the hook-shaped structures.

Preferably, a lower end of the conductive piece is provided with a receiving connecting hole, a fixed end of the clamping piece is provided with a receiving and connecting sheet inserted into the receiving connecting hole. The receiving connecting hole and the receiving and connecting sheet cooperate with each other to further clamp the first inclined surface and the second inclined surface.

Preferably, the conductive piece lower part is further provided with a bending portion, the bending portion is in a recessed structure and is integrally formed with the first inclined surface, and an included angle is formed between the bending portion and the first inclined surface.

Preferably, the housing includes a front end cover and a rear end cover, the front end cover is of an opening structure provided with a front end cover upper part and a front end cover lower part, an rear end cover upper part is provided with a sheet-like structure, the front end cover upper part is provided with a receiving connecting hole that is of a sheet-like structure and cooperates with the rear end cover, the sheet-like structure receiving connecting hole cooperates with the sheet-like structure of the rear end cover to realize connection and cooperation of the front end cover and the rear end cover; the conductive piece upper part is provided with an upper baffle, a conductive piece upper baffle end is provided with an upper baffle protrusion, an upper baffle protrusion upper surface is higher than an upper baffle upper surface, and is lower than or equal to a receiving connecting hole lower surface, and the upper baffle protrusion is suitable for fixing the conductive piece upper part between the front end cover and the rear end cover when receiving and connecting is performed on the front end cover and the rear end cover.

Preferably, the conductive piece cooperates with and is connected to the front end cover. A front end cover lower surface is coplanar with a conductive piece lower surface. The conductive piece 2 lower part is further provided with a cooperating protrusion piece, a bending surface is formed between the cooperating protrusion piece and the bending portion, the cooperating protrusion piece is further provided with a cooperating protrusion opening, and the front end cover lower part is provided with a cooperating receiving and connecting sheet cooperating with the cooperating protrusion opening.

Preferably, a wire passing window is arranged between the conductive piece upper part and the conductive piece lower part, a limiting sheet is arranged above the wire passing window, and the limiting sheet is transitionally connected to a guiding slope surface.

Preferably, the wiring switch is rotatably assembled in the housing, the wiring switch includes a switch handle, a pressing head, and a rotating shaft, an upper surface end of the switch handle is further provided with a switch handle bulge. When the switch handle is rotated to a certain angle, the switch handle bulge abuts against the front end cover, and thereby the switch handle is restricted from continuing to rotate.

Preferably, a front end cover side is provided with a first clamping protrusion, and the rear end cover is provided with a first clamping groove cooperating with the first clamping protrusion. The first clamping protrusion and the first clamping groove are clamped to connect front end cover sides and a rear end cover side, a front end cover lower surface is provided with a second clamping protrusion, and the rear end cover is provided with a second clamping groove cooperating with the second clamping protrusion. The second clamping protrusion and the second clamping groove are clamped to connect lower parts of the front end cover and the rear end cover.

By adopting the foregoing technical solutions, this utility model may have the following technical effects:

According to the wiring terminal in this application, the conductive piece and the clamping piece cooperate with each other to form a natural state in which the conducting wire placed in the mounting channel is clamped between the clamping piece and the conductive piece through elastic abutment, thereby ensuring stable clamping of the clamping and connecting piece, to implement a stable electrical connection between conducting wires. When the conducting wire needs to be drawn away, the wiring switch triggers the pressed state in which the clamping piece deforms, relative to the conductive piece, along a direction distal from the clamped conducting wire to unclamp the conducting wire and facilitate drawing away from the conducting wire. This avoids incomplete close-fitting between the conductive piece and the clamping piece and impact on an electrical connection between conducting wires that are caused by directly pushing by using the conducting wire.

Further, it is set that the conductive piece is of a C-shaped frame structure with an upper part and a lower part, the clamping piece is in a straight-line shaped structure, a lower part end of the conductive piece is provided with a first inclined surface, a clamping piece lower part is provided with a second inclined surface, and the first inclined surface and the second inclined surface are parallel to each other and are closely attached through a connecting structure, to realize cooperation and connection of the conductive piece and the clamping piece. In addition, a lower end of the conductive piece is provided with a receiving connecting hole, a fixed end of the clamping piece is provided with a receiving and connecting sheet inserted into the receiving connecting hole, and the receiving connecting hole and the receiving and connecting sheet cooperate with each other to further clamp the first inclined surface and the second inclined surface, so that the inserted conducting wire can be clamped between a spring plate and the conductive sheet, thereby ensuring a more stable electrical connection.

BRIEF DESCRIPTION OF THE DRAWINGS

To illustrate the technical solutions in the implementations of this utility model more clearly, the following will briefly introduce the drawings that need to be used in the implementations. It should be understood that the drawings described below show only some embodiments of this utility model and should not be regarded as a limitation of scope, and for a person of ordinary skill in the art, other related drawings may also be obtained based on these drawings without creative work.

DESCRIPTION OF THE EMBODIMENTS

Figure 1:
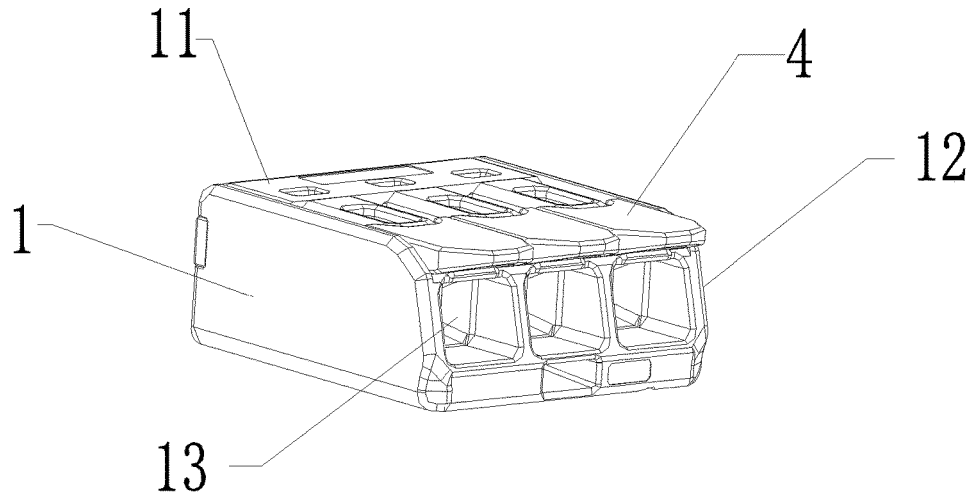
FIG. 1 is a perspective view of a wiring terminal according to an embodiment of this utility model.

To make objectives, technical solutions, and advantages of the embodiments of this utility model clearer, the technical solutions in the implementations of this utility model will be clearly and completely described below in combination with the accompanying drawings in the implementations of this utility model. Obviously, the described implementations are a part of the implementations of the utility model rather than all of the implementations. All other embodiments obtained by persons of ordinary skill in the art based on the embodiments of this utility model without creative efforts shall fall within the protection scope of the utility model. Therefore, the detailed description of the embodiments of the utility model in the accompanying drawings is not intended to limit the protection scope of the utility model and are merely selected embodiments of the utility model.

Embodiment

With reference to FIG. 1 to FIG. 4, this embodiment provides a wiring terminal used to insert and connect to a conducting wire, including a housing 1, a conductive piece 2, a clamping piece 3, and a wiring switch 4. The housing 1 is provided with a mounting channel (not shown in the figure) and an insertion hole 13 communicating with the mounting channel. The conductive piece 2 and the clamping piece 3 are configured in the mounting channel. The clamping piece 3 is in a straight-line shaped structure as a whole, the conductive sheet is of a C-shaped frame structure with a conductive piece upper part and a conductive piece lower part, the conductive piece upper part is provided with an upper baffle 21, and the conductive piece lower part is provided with a bending portion 22. One end of the conductive piece 2 lower part and one end of the clamping piece 3 are fixed to each other, and the other end of the clamping piece 3 may move up and down freely to form a free end of the clamping piece 3. Therefore, the bending portion 22 of the conductive piece 2 and the clamping piece 3 are arranged at an included angle. The clamping piece has two states: a natural state and a pressed state. The included angle between the bending portion 22 of the conductive piece 2 and the clamping piece 3 can reflect the state of the clamping piece 3. In the natural state, when there is no conducting wire in the wiring terminal, the included angle between the bending portion 22 of the conductive piece 2 and the clamping piece 3 is at the maximum; and when there is a conducting wire in the wiring terminal, the included angle between the bending portion 22 of the conductive piece 2 and the clamping piece 3 becomes smaller due to a space-occupying effect of the conducting wire, but the conducting wire of the clamping piece that is placed in a mounting channel is clamped between the upper baffle 21 and the clamping piece 3 in a restoring force. In the pressed state, the clamping piece 3 is controlled by an external force to deform in a direction distal from the clamped conducting wire. The wiring switch 4 can correspondingly trigger the clamping piece 3 to switch between the natural state and the pressed state. The conducting wire is capable of passing through the insertion hole 13, and is clamped in the conductive piece 2 and the clamping piece 3. The wiring switch 4 triggers the clamping piece 3 to switch from the natural state to the pressed state to unclamp the conducting wire, so that the conducting wire can detach from the conductive piece 2 and the clamping piece 3, to facilitate drawing away the conducting wire.

Figure 5:
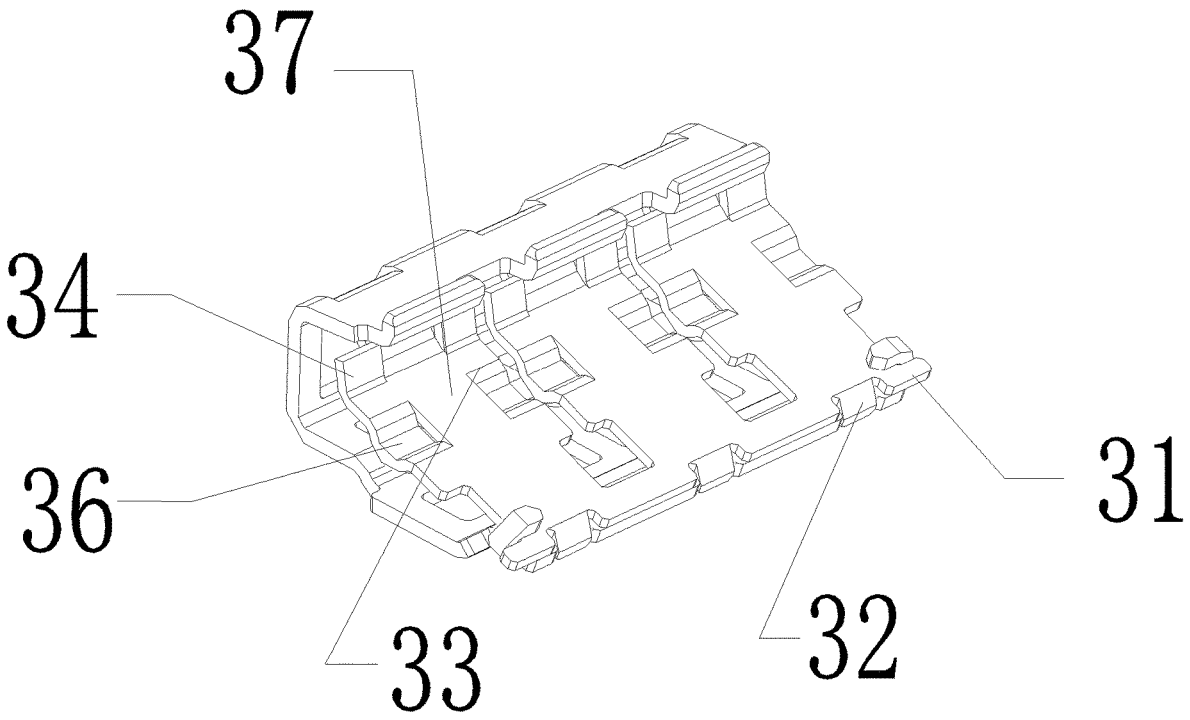
FIG. 5 is a perspective view 1 of cooperation between a conductive piece and a clamping piece according to an embodiment of this utility model.

With reference to FIG. 5 of this specification, in this embodiment, the conductive piece 2 and the clamping piece 3 cooperate with each other, and the clamping piece 3 is correspondingly in the natural state when the conducting wire is placed in the mounting channel. The conducting wire is clamped between the clamping piece 3 and the conductive piece 2 through elastic abutment, thereby ensuring a stable electrical connection between conducting wires in the wiring terminal. When the conducting wire needs to be drawn away, the wiring switch 4 is turned on to trigger the clamping piece 3 to switch from the natural state to the pressed state. In this case, the clamping piece 3 is pressed by the wiring switch 4 to deform along a direction distal from the clamped conducting wire, to unclamp the conducting wire, and facilitate drawing away the conducting wire. This may avoid damage to the conducting wire and the clamping piece 3 caused by direct drawing away, and incomplete close-fitting between the conducting wire and the wiring terminal and impact an electrical connection between conducting wires caused by directly pushing the clamping piece 3 by using the conducting wire.

Figure 6:
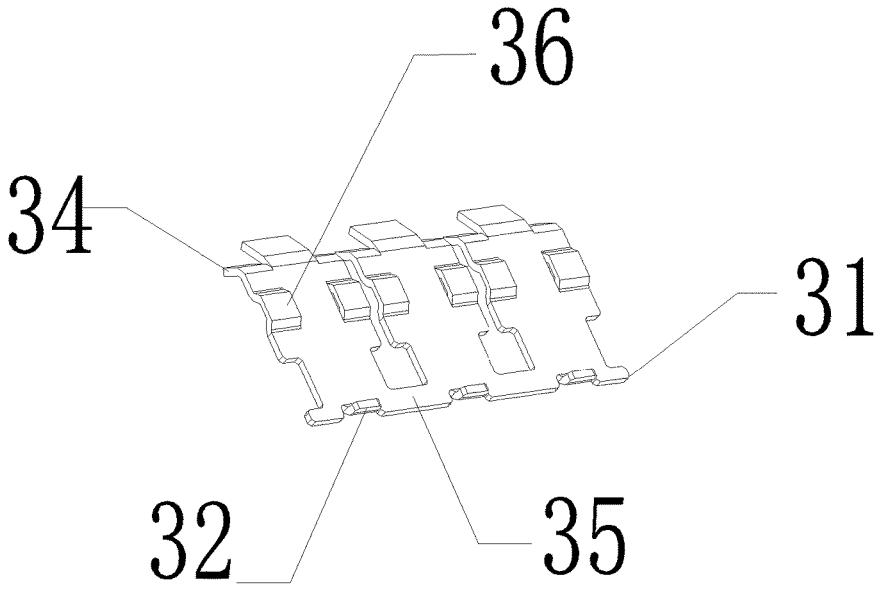
FIG. 6 is a schematic diagram of cooperation between clamping pieces according to an embodiment of this utility model.

In one of the implementations, with reference to FIG. 5 and FIG. 6 of this specification, the conductive piece 2 is provided with an opening, the opening has an upper part and a lower part, the upper part is provided with an upper baffle 21, the lower part is provided with a bending portion 22, and an upper surface of a lower part end of the opening is provided with a first inclined surface 24, a lower surface of one end of the clamping piece 3 is provided with a second inclined surface 35, and the first inclined surface 24 and the second inclined surface 35 are parallel to each other and are closely attached. One side of the first inclined surface 24 is provided with a first connecting structure 23, a corresponding side of the second inclined surface is provided with a second connecting structure 31. Both the first connecting structure 23 and the second connecting structure 31 are hook-shaped structures, and the first inclined surface 24 and the second inclined surface 35 are mutually fitted through the mutually hooking and riveting of the hook-shaped structures. Therefore, the lower part end of the opening forms a fixed end.

The reason why the connecting structure is used to fix the first inclined surface and the second inclined surface is that firstly, the first inclined surface and the second inclined surface may be fixed to each other more firmly without relative displacement due to an external force. Secondly, positioning and connection of the first inclined surface and the second inclined surface can be easily realized, and it is easy to realize alignment and production of large-scale configuration connections. Compared to direct fitting connection between the first inclined surface and the second inclined surface, the connecting structure connection of this application requires a lower positioning accuracy, and an ambiguous connecting structure is a coordinate, which will not cause a misaligned connection due to inaccurate positioning.

For specific settings, please refer to FIG. 5 of this specification, the first connecting structure 23 of the conductive piece 2 is clamped above the second connecting structure 31 of the clamping piece 3. In this case, when the clamping piece 3 receives a forward force, the first connecting structure 23 of the conductive piece 2 can prevent the clamping piece 3 from moving forward through a clamping effect.

The first connecting structure 23 and the second connecting structure 31 are respectively arranged on two sides of the conductive piece 2 and the clamping piece 3. To further ensure that the first inclined surface 24 and the second inclined surface 35 are closely attached so that one end of the clamping piece 3 is fixed to the end of the conductive piece, a lower end of the conductive piece is provided with a receiving connecting hole 25, and correspondingly, a fixed end of the clamping piece is provided with a receiving and connecting sheet 32 inserted into the receiving connecting hole 25. The receiving connecting hole and the receiving and connecting sheet cooperate with each other to further clamp the first inclined surface 24 and the second inclined surface 35. The bending portion 22 and the first inclined surface 24 are integrally formed with an included angle formed between them. By providing the bending portion 22, the conductive piece 2 lower part is not a plane but a recessed structure. Therefore, increasing an area of an elastic piece that participates inelastic deformation can increase an elastic force between the conductive piece 2 and the clamping piece 3. Preferably, the bending portion is parallel to a plane where the conducting wire is in contact with the wiring terminal.

Figure 7:
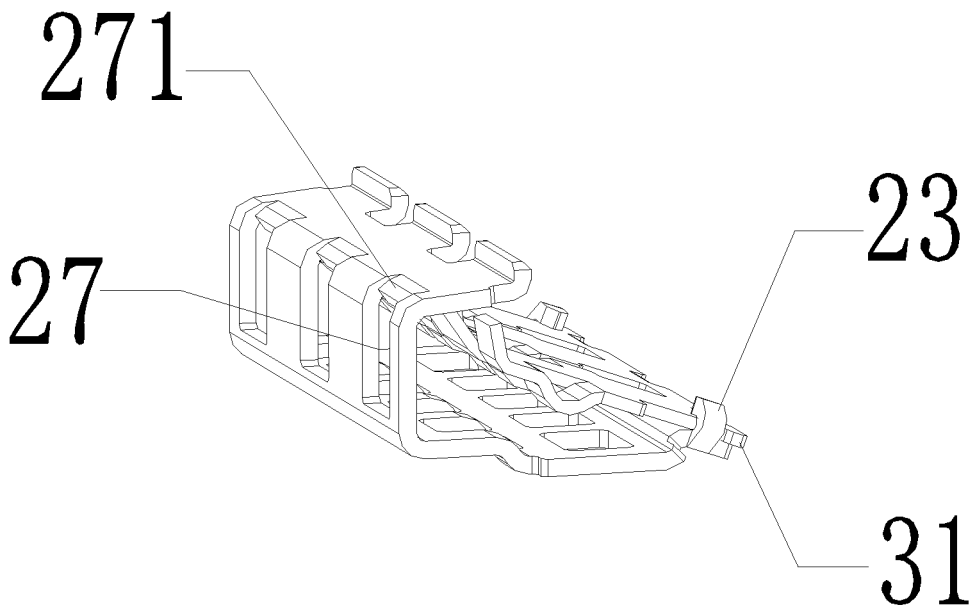
FIG. 7 is a perspective view 2 of cooperation between a conductive piece and a clamping piece according to an embodiment of this utility model.
Figure 8:
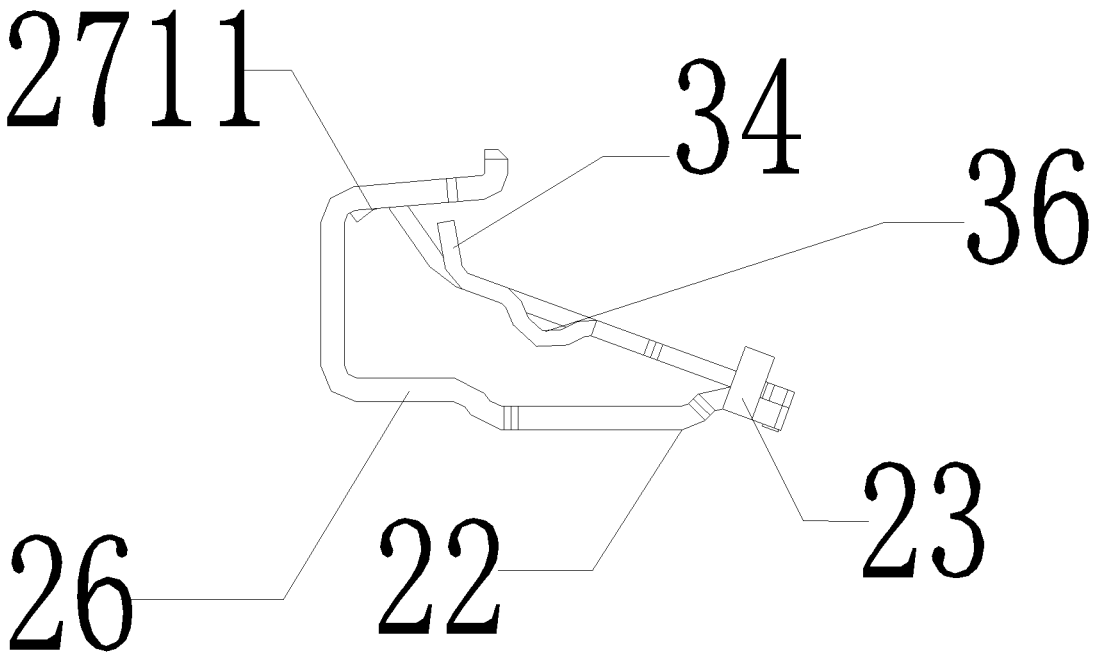
FIG. 8 is a side view of FIG. 7.

In an embodiment, with reference to FIG. 7 and FIG. 8 of this specification, the bending portion 22 of the conductive piece 2 lower part and the upper baffle 21 of the conductive piece 2 upper part integrally form a conductive sheet with a C-shaped opening. The free end of the clamping piece 3 moves up and down in the conductive sheet with the C-shaped opening, which causes a size of a space between the clamping piece 3 and the upper baffle 21 of the conductive piece 2 upper part to change, so that the inserted conducting wire can be inserted into the space and be clamped between the clamping piece 3 and the conductive piece 2, thereby ensuring a more stable electrical connection.

In an embodiment, the clamping piece 3 is roughly obliquely disposed so that an included angle less than 90° is formed between the free end of the clamping piece and the upper baffle 21 of the conductive piece 2 upper part. Particularly, the included angle between the free end and the conductive portion 223 ranges between 30° and 60°. The conducting wire that enters the mounting channel along the insertion hole 13 can be more smoothly clamped in the wiring terminal along the included angle between the free end and the upper baffle 21.

Figure 9:
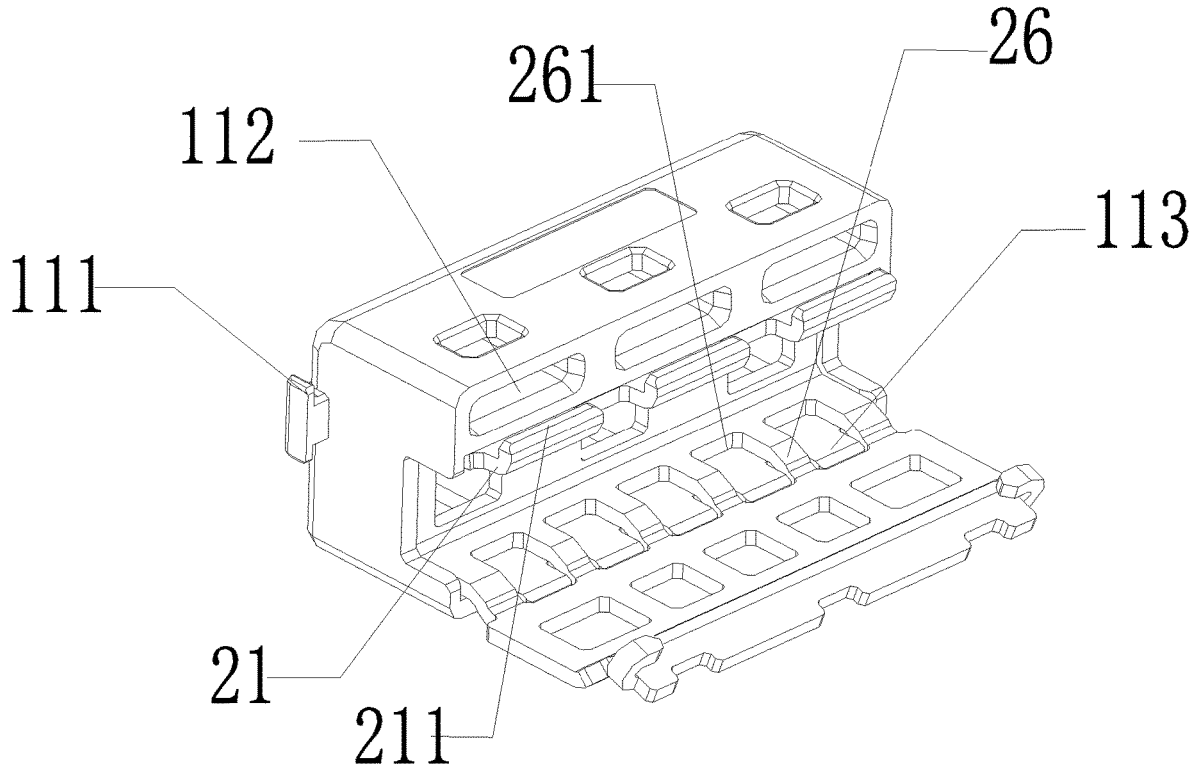
FIG. 9 is a perspective view of cooperation between a conductive piece and a front end cover according to an embodiment of this utility model.

In an embodiment, with reference to FIG. 9 of the specification, the conductive piece 2 is correspondingly provided with a wire passing window 27 along an insertion direction of the conducting wire, and the conducting wire inserted in and connected to the conductive piece 2 can extend out of the wire passing window 27, thereby preventing the conducting wire from being bent. The wire passing window 27 is located between the conductive piece 2 upper part and the conductive piece 2 lower part, and particularly, the wire passing window 27 can be formed by opening a window between the conductive piece 2 upper part and the conductive piece 2 lower part for the conducting wire to pass through. The conductive piece 2 cooperates with and is connected to the front end cover 11, a front end cover lower surface is coplanar with a conductive piece lower surface, and specifically, in addition to the bending portion 22, the conductive piece 2 lower part is further provided with a cooperating protrusion piece 26. A bending surface is formed between the cooperating protrusion piece 26 and the bending portion 22 that are not coplanar. The cooperating protrusion piece 26 is further provided with a cooperating protrusion opening 261, and the front end cover 11 lower part is provided with a cooperating receiving and connecting sheet 113 cooperating with the cooperating protrusion opening 261. Specifically, the cooperating receiving and connecting sheet 113 is inserted into the cooperating protrusion opening 261, the cooperating protrusion piece 26 lower surface is attached to a plane where the upper surface of the cooperating receiving and connecting sheet 113 is located, and the conductive piece forms a protrusion for accommodating the front end cover 11 lower part through the cooperating protrusion piece 26. When the conductive piece cooperates with the front end cover, the front end cover lower surface may be coplanar with the conductive piece lower surface by using the protrusion that accommodates the front end cover 11 lower part.

Figure 2:
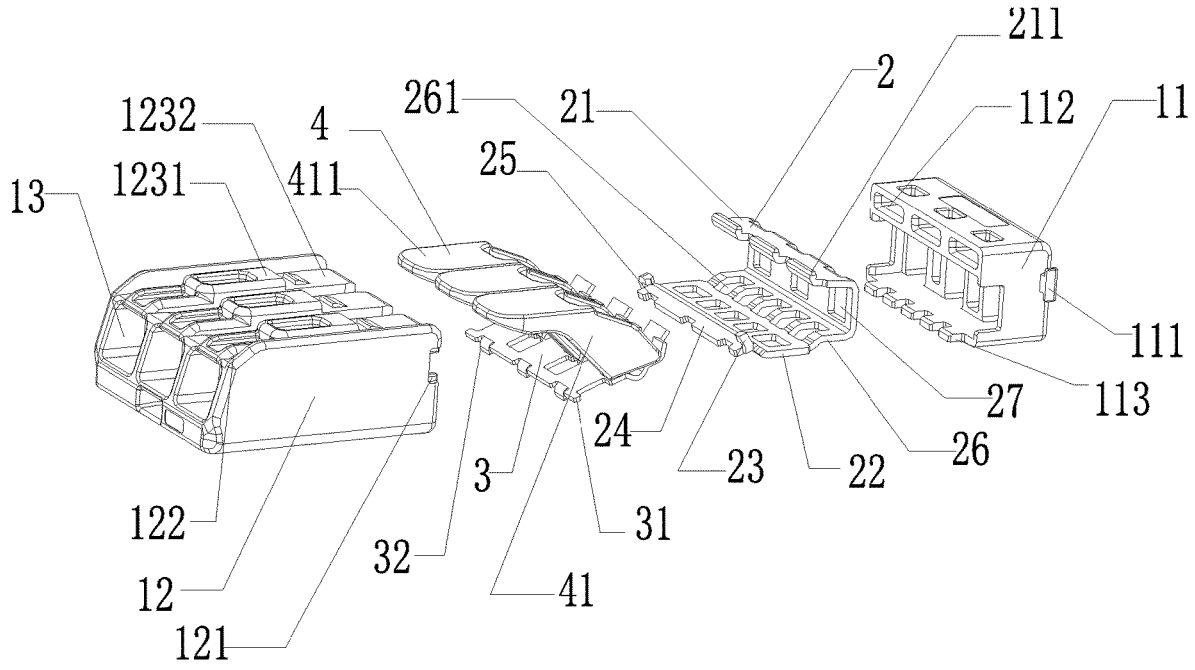
FIG. 2 is a schematic exploded view of each component according to an embodiment of this utility model.
Figure 3:
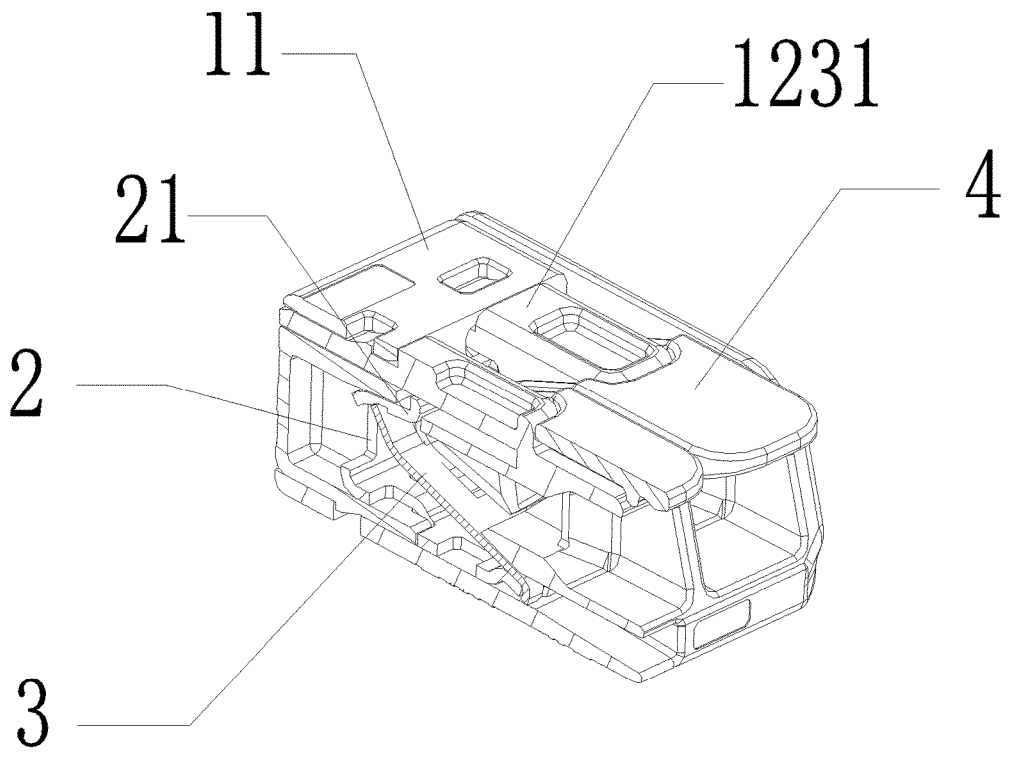
FIG. 3 is a cross-sectional view along a middle section of a wiring terminal according to an embodiment of this utility model.
Figure 4:
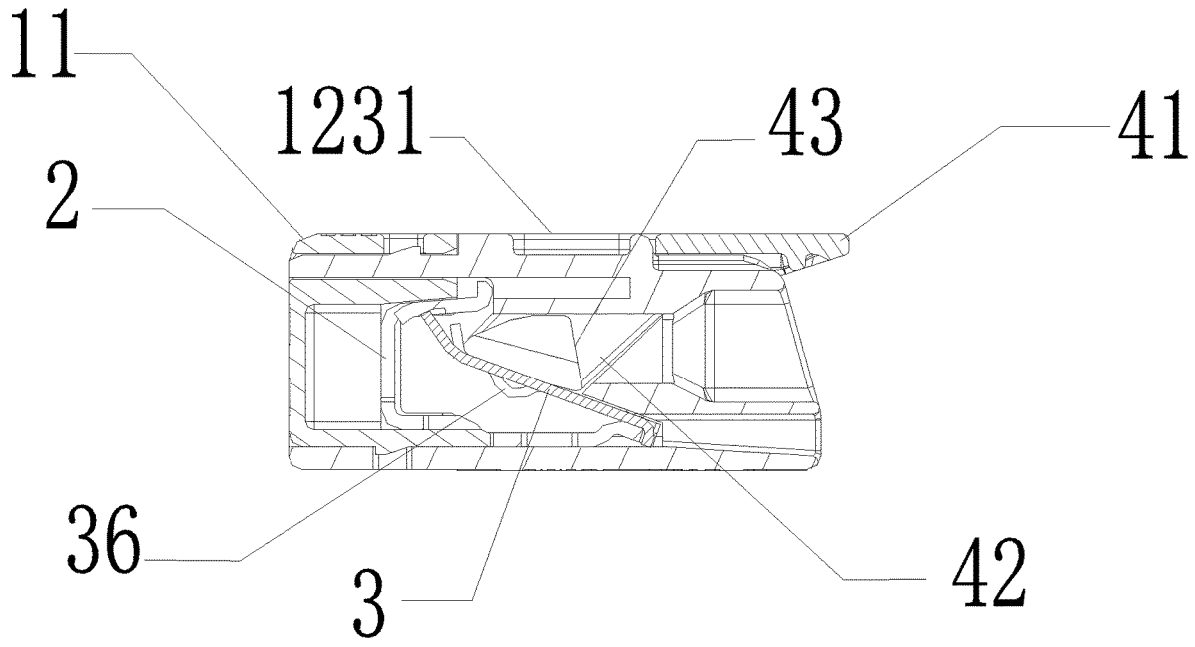
FIG. 4 is a schematic diagram of a section in FIG. 3.

With reference to FIG. 2 of this specification, the front end cover 11 is also in an opening structure provided with an upper part and a lower part. The front end cover 11 upper part is provided with a receiving connecting hole 112 that is of a sheet-like structure and cooperates with the rear end cover, and the sheet-like structure receiving connecting hole 112 cooperates with the sheet-like structure 123 of the rear end cover 12 to realize connection and cooperation of the front end cover 11 and the rear end cover 12. A lower surface of the structure (the front end cover 11 upper part) of the sheet-like structure receiving connecting hole 112 is higher than or can be attached to the upper baffle 21 upper surface, and therefore a front end structure of the conductive piece 2 can be accommodated in the opening structure formed by the front end cover 11. An upper baffle 21 end of the conductive piece is provided with an upper baffle protrusion 211, an upper baffle protrusion is higher than an upper baffle upper surface, and is lower than or equal to a lower surface of the sheet-like structure receiving connecting hole 112. The upper baffle protrusion 211 is suitable for fixing the conductive piece 2 upper part between the front end cover 11 and the rear end cover 12 when receiving and connecting is performed on the front end cover 11 and the rear end cover 12. The opening structure formed by the front end cover 11 upper part and the front end cover 11 lower part is integrally formed, which is convenient for manufacturing and disassembly. The sheet-like structure 123 is further provided with a sheet-like structure protrusion 1231, the sheet-like structure protrusion 1231 abuts against the switch handle 41, and an upper surface of the sheet-like structure protrusion 1231, the upper surface of the switch handle 41, and the upper surface of the front end cover is coplanar.

In an embodiment, with reference to FIG. 7 and FIG. 8 of this specification, a limiting sheet 271 is arranged above the wire passing window 27 of the conductive piece 2, and the limiting sheet 271 corresponds to the free end of the clamping piece 3. When the clamping piece 3 is in the natural state, the free end of the clamping piece 3 is limited in the limiting sheet 271, and the limiting sheet 271 is transitionally connected to a guiding slope surface 2711 along a direction in which the free end detaches from the limiting sheet 271. The clamping piece 3 is clamped in the limiting sheet 271 when the clamping piece 3 is in the natural state, thereby preventing the clamping piece 3 from continuously moving outwards so that assembly of the clamping piece 3 and the conductive piece 2 is more stable to clamp the conducting wire. In addition, the guiding slope surface 2711 ensures smooth switching of the clamping piece 3 between the natural state and the pressed state.

In an embodiment, the housing 1 is provided with a plurality of mounting channels, and each mounting channel is correspondingly provided with the insertion hole 13, and a clamping structure formed by cooperation of the conductive piece 2 cooperating with the mounting channel and the clamping piece 3. Clamping sheets 37 of the clamping piece 3 correspond to the mounting channels one by one, and the clamping sheets 37 are all assembled in one shared conductive piece 2, to implement an efficient electrical connection. In addition, the clamping sheets 37 are connected to each other and integrally formed to form the clamping piece 3, which is convenient for manufacturing and disassembly.

Figure 10:
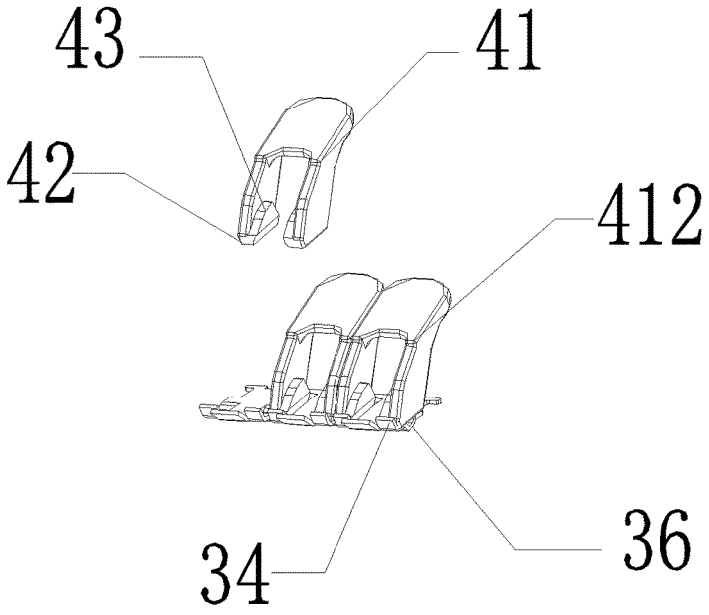
FIG. 10 is a perspective view of cooperation between a wiring switch and a clamping piece according to an embodiment of this utility model.

Referring to FIG. 2 and FIG. 10 of this specification, the wiring switch 4 is rotatably assembled in the housing 1, the wiring switch 4 includes a switch handle 41, a pressing head 42, and a rotating shaft 43, and the switch handle 41 is hingedly connected to the housing 1 through the cooperation of the rotating shaft 43, so that the switch handle 41 can rotate relative to the housing 1, to correspondingly drive the pressing head 42 to trigger the clamping piece 3 to switch a status of the clamping piece 3. It should be mentioned that the wiring switch 4 is hingedly connected to the housing 1 by using the rotating shaft 43. Specifically, a side of the insertion hole of the rear end cover 12 is provided with an insertion gap 122 for the switch handle 41 to be inserted, so that when the wiring switch 4 is in a first state, the upper surface of the switch handle 41 of the wiring switch 4 can be horizontally assembled above the rear end cover 12. When the wiring switch 4 is in a second state, the switch handle 41 of the wiring switch 4 is pulled upwards to drive the pressing head 42 to rotate. The pressing head 42 always abuts against the clamping piece 3, and rotation of the pressing head 42 drives the free end of the clamping piece 3 to move downward. Particularly, in this embodiment, the rotating shaft 43 is an irregular polygon and can rotate in the insertion gap 122. In addition, when the switch handle 41 is in the first state or the second state, corresponding sides of the rotating shaft 43 all abut against sidewalls of the insertion gap 122, thereby limiting the pressing handle 31 to only perform switching between the first state and the second state. Specifically, a rotating shaft clamping portion 125 is arranged below the sheet-like structure 123 of the rear end cover 12, and the corresponding sides of the rotating shaft 43 all abut against sidewalls of the rotating shaft clamping portion 125, thereby limiting the pressing handle 31 to only perform switching between the first state and the second state. The rotating shaft 43 and the pressing head 42 are integrally disposed, and the rotating shaft 43 and the pressing head 42 are connected through smooth jointing. An upper surface 411 end of the switch handle is further provided with a switch handle bulge 412, and when the switch handle is rotated to a certain angle, the switch handle bulge 412 abuts against the front end cover, and thereby the switch handle 41 is restricted from continuing to rotate.

In an embodiment, with reference to FIG. 5 and FIG. 6 of this specification, the pressing head 42 is linked to the clamping piece 3 by using a pressing contact sheet 33 on the clamping piece 3, the pressing contact sheet 33 and the pressing head 32 are always in a mutually abutting state, and the pressing contact sheet 33 has a pressing limiting surface 34 and a pressing contact concave surface 36. The pressing limiting surface 34 abuts against the pressing head 42; the pressing contact concave surface 36 prevents the pressing head 42 from continuing rotating along a rotation direction of the switch handle 41 to limit an upward or downward hinged rotation angle of the switch handle 41. Both the pressing limiting surface 34 and the pressing contact concave surface 36 is formed after the pressing contact sheet 33 relatively recesses inwardly to form a bending section so that each bending section can abut against the pressing head 42 to limit each other. When the wiring switch 4 is in the first state, the pressing head 42 abuts against the pressing limiting surface 34, and the switch handle 41 is pulled upwards by a user to switch the wiring switch 4 to the second state. In this case, the pressing head 42 abuts against the pressing contact concave surface 36, to further limit the wiring switch 4 from being continuously pulled. Particularly, two pressing heads 42 are oppositely disposed on two inner side surfaces of the wiring switch 4 at an interval. The pressing contact sheet 33 and the two pressing heads 42 are oppositely disposed, and respectively extend on two sides of the clamping sheet 37, so that the pressing head 42 directly drives to press the clamping sheet 37 by using the pressing contact sheet 33, and thereby the pressing head 42 moves to trigger the clamping piece 3 to perform switching between the natural state and the pressed state.

In another embodiment, the pressing contact sheet 33 and the clamping sheet 37 are integrally formed and extend on the two sides of the clamping sheet 37, which is easy to manufacture and facilitates the wiring switch 4 directly pressing to trigger the clamping sheet 37.

Figure 11:
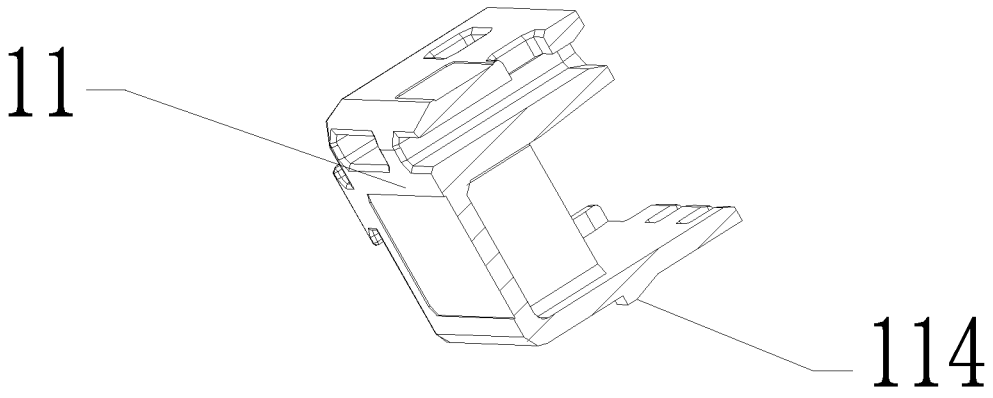
FIG. 11 is a cross-sectional view along a middle section of a front end cover according to an embodiment of this utility model.
Figure 12:
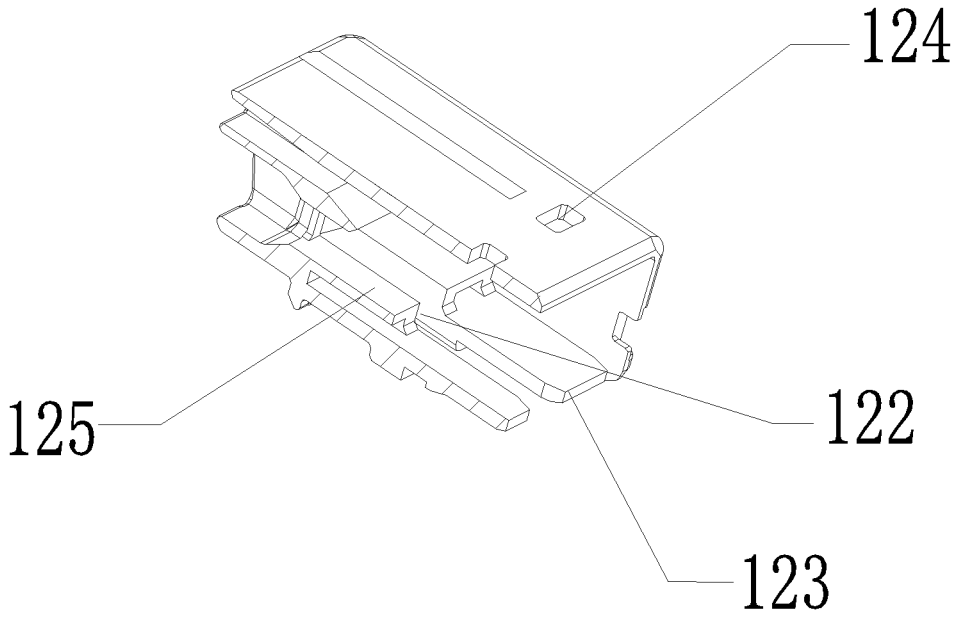
FIG. 12 is a cross-sectional view along a middle section of an inverted rear end cover according to an embodiment of this utility model, where signs: 1-housing; 11-front end cover; 111-first clamping protrusion; 112-sheet-like structure receiving connecting hole; 113-cooperating receiving and connecting sheet; 114-second clamping protrusion; 12-rear end cover; 121-first clamping groove; 122-insertion gap; 123-sheet-like structure; 1231-sheet-like structure protrusion; 1232-sheet-like structure receiving and connecting surface; 124-second clamping hole; 125-rotating shaft clamping portion; 13-insertion hole; 2-conductive piece (busbar); 21-upper baffle; 211-upper baffle protrusion; 22-bending portion; 23-first connecting structure; 24-first inclined surface; 25-receiving connecting hole; 26-cooperating protrusion piece; 261-cooperating protrusion opening; 27-wire passing window; 271-limiting sheet; 2711-guiding slope surface; 3-clamping piece; 31-second connecting structure; 32-receiving and connecting sheet; 33-pressing contact surface; 34-pressing limiting surface; 35-second inclined surface; 36-pressing contact concave surface; 37-clamping sheet; 4-wiring switch; 41-switch handle; 411-upper surface of the switch handle; 412-switch handle bulge; 42-pressing head; 43-rotating shaft.

With reference to FIG. 2, FIG. 11, and FIG. 12 of this specification, the housing 1 includes a front end cover 11 and a rear end cover 12. Particularly, a front end cover 11 side is provided with a first clamping protrusion 111 and the rear end cover is provided with a first clamping groove 121 cooperating with the first clamping protrusion 111, and the first clamping protrusion and the first clamping groove are clamped to connect front end cover sides and rear end cover sides. A front end cover 11 lower surface is provided with a second clamping protrusion 114, the rear end cover is provided with a second clamping groove 124 cooperating with the second clamping protrusion 114, and the second clamping protrusion 114 and the second clamping groove 124 are clamped to connect lower parts of the front end cover and the rear end cover. In addition, the foregoing front end cover 11 upper part is provided with a receiving connecting hole 112 that is of a sheet-like structure and cooperates with the rear end cover. The sheet-like structure receiving connecting hole 112 cooperates with the sheet-like structure 123 of the rear end cover 12 to realize connection and cooperation of upper surfaces of the front end cover 11 and the rear end cover 12. In this way, multi-surface clamping of the upper surfaces, the lower surfaces, front end cover sides, and rear end cover sides is realized, thereby effectively ensuring assembly of the front end cover and the rear end cover. The rear end cover 12 is in a box-shaped structure, and the front end cover 11, the conductive piece 2, and the clamping piece 3 can be completely contained therein.

The two end covers are also assembled and connected by using a quick disassembly piece (not shown in the figure), and the insertion hole 13 is provided in the rear end cover 12, and is passable through, via the mounting channel, an inner cavity formed by assembling the two end covers. The quick disassembly piece may be disassembled and assembled through buckling, which is easy to perform maintenance. In another embodiment, an adsorption quick disassembly piece, a male-female quick disassembly piece, or the like may also be used, which are all extensions of this specification, and are not repeated herein.

What is described above are only preferred embodiments of this utility model, and the protection scope of this utility model is not limited to the foregoing embodiments. All technical solutions that fall under the idea of this utility model belong to the protection scope of this utility model.

What is claimed is:

1. A wiring terminal, used for receiving and connecting to a conducting wire, the wiring terminal comprising:

a housing, provided with a mounting channel and an insertion hole communicating with the mounting channel for the conducting wire to be inserted;

a conductive piece and a clamping piece, both of which are arranged in the mounting channel, wherein the conductive piece and the clamping piece cooperate to form a natural state in which the conducting wire placed in the mounting channel is clamped between the clamping piece and the conductive piece through elastic abutment and a pressed state in which the conductive piece and the clamping piece are controlled by an external force to deform in a direction distal from a clamped conducting wire, and the conductive piece has a first inclined surface which is inclined with respect to an insertion direction of the conducting wire, and the clamping piece has a second inclined surface that is parallel to and in close contact with the first inclined surface; and a wiring switch, wherein the wiring switch is capable of correspondingly triggering relative positions of the conductive piece and the clamping piece so that the conductive piece and the clamping piece switch between the natural state and the pressed state;

wherein the conductive piece is of a C-shaped frame structure with a conductive piece upper part and a conductive piece lower part, the clamping piece is a generally flat structure, a lower part end of the conductive piece is provided with the first inclined surface, a clamping piece lower part is provided with the second inclined surface, the first inclined surface and the second inclined surface are parallel to each other and are closely attached through a first connecting structure and a second connecting structure, the first connecting structure is provided on a conductive piece side portion, the second connecting structure is provided on a clamping piece side portion, both the first connecting structure and the second connecting structure are hook-shaped structures, and the first inclined surface and the second inclined surface are mutually fitted through mutually hooking of the hook-shaped structures; a lower end of the conductive piece is provided with a receiving connecting hole, a fixed end of the clamping piece is provided with a receiving and connecting sheet inserted into the receiving connecting hole, and the receiving connecting hole and the receiving and connecting sheet cooperate with each other to further clamp the first inclined surface and the second inclined surface.

2. The wiring terminal according to claim 1, wherein the conductive piece lower part is further provided with a bending portion, the bending portion is in a recessed structure and is integrally formed with the first inclined surface, and an included angle is formed between the bending portion and the first inclined surface.

3. The wiring terminal according to claim 2, wherein the housing comprises a front end cover and a rear end cover, the front end cover is of an opening structure provided with a front end cover upper part and a front end cover lower part, an rear end cover upper part is provided with a sheet-like structure, the front end cover upper part is provided with a receiving connecting hole that is of a sheet-like structure and cooperates with the rear end cover, the sheet-like structure receiving connecting hole cooperates with the sheet-like structure of the rear end cover to realize connection and cooperation of the front end cover and the rear end cover; the conductive piece upper part is provided with an upper baffle, a conductive piece upper baffle end is provided with an upper baffle protrusion, an upper baffle protrusion upper surface is higher than an upper baffle upper surface, and is lower than or equal to a lower surface of the receiving connecting hole, and the upper baffle protrusion is suitable for fixing the conductive piece upper part between the front end cover and the rear end cover when receiving and connecting is performed on the front end cover and the rear end cover.

4. The wiring terminal according to claim 3, wherein the conductive piece cooperates with and is connected to the front end cover, a front end cover lower surface is coplanar with a conductive piece lower surface, and the conductive piece lower part is further provided with a cooperating protrusion piece, a bending surface is formed between the cooperating protrusion piece and the bending portion, the cooperating protrusion piece is further provided with a cooperating protrusion opening, and the front end cover lower part is provided with a cooperating receiving and connecting sheet cooperating with the cooperating protrusion opening.

5. The wiring terminal according to claim 3, wherein the wiring switch is rotatably assembled in the housing, the wiring switch comprises a switch handle, a pressing head, and a rotating shaft, an upper surface end of the switch handle is further provided with a switch handle bulge, and when the switch handle is rotated to a certain angle, the switch handle bulge abuts against the front end cover, and thereby the switch handle is restricted from continuing to rotate.

6. The wiring terminal according to claim 3, wherein a front end cover side is provided with a first clamping protrusion and the rear end cover is provided with a first clamping groove cooperating with the first clamping protrusion, the first clamping protrusion and the first clamping groove are clamped to connect the front end cover sides and a rear end cover side, a front end cover lower surface is provided with a second clamping protrusion, the rear end cover is provided with a second clamping groove cooperating with the second clamping protrusion, and the second clamping protrusion and the second clamping groove are clamped to connect lower parts of the front end cover and the rear end cover.

7. The wiring terminal according to claim 1, wherein a wire passing window is arranged between the conductive piece upper part and the conductive piece lower part, a limiting sheet is arranged above the wire passing window, and the limiting sheet is transitionally connected to a guiding slope surface.

* * * * *